United States Patent [19]

Brock

[11] 4,323,270

[45] Apr. 6, 1982

[54] PIPE FITTING DEVICE FOR PLUMBING SYSTEMS

[76] Inventor: James A. Brock, 2166 West Blvd., Cleveland, Ohio 44102

[21] Appl. No.: 163,107

[22] Filed: Jun. 26, 1980

[51] Int. Cl.[3] ..... F16L 41/02

[52] U.S. Cl. ..... 285/153; 4/211

[58] Field of Search ..... 285/150, 179, 153, 154; 4/211, DIG. 7

[56] References Cited

U.S. PATENT DOCUMENTS

| | | | |
|---|---|---|---|
| 622,326 | 4/1899 | Burnett | 285/179 X |
| 911,748 | 2/1909 | McGuire | 285/153 |
| 1,152,974 | 9/1915 | Rice | 285/179 X |
| 1,362,718 | 12/1920 | McNamara | 285/154 |
| 2,237,672 | 4/1941 | Kennedy | 285/153 |
| 2,439,712 | 4/1948 | Brady | 285/150 X |
| 2,866,981 | 1/1959 | McMinn | 285/150 X |
| 3,850,459 | 11/1974 | Blumenkranz et al. | 285/156 |

FOREIGN PATENT DOCUMENTS

| | | | |
|---|---|---|---|
| 937626 | 1/1956 | Fed. Rep. of Germany | 285/179 |
| 695784 | 8/1953 | United Kingdom | 285/150 |

*Primary Examiner*—Thomas F. Callaghan

*Attorney, Agent, or Firm*—Watts, Hoffmann, Fisher & Heinke Co.

[57] ABSTRACT

This invention relates generally to fittings used in plumbing systems, and more particularly relates to a new and improved construction for a fitting device of the type for use intermediate of and connecting water closets, sinks, baths, basins or the like with the main waste or soil pipe and with the main vent pipe. In the invention, such fitting device may be employed advantageously in new construction or in the repair of existing plumbing systems such as in re-modeling or the like. The fitting is of a unitary, one-piece construction made from a plastic material having a hollow cylindrical body with an inlet end and an outlet end. Intermediate the inlet and outlet ends, there is an integral transversely extending hub section of a generally figure-eight construction defined by an oppositely disposed pair of superposed vent and/or waste openings adapted for use as a vent and/or waste for the plumbing system.

4 Claims, 11 Drawing Figures

PIPE FITTING DEVICE FOR PLUMBING SYSTEMS

BACKGROUND OF THE INVENTION

The present invention relates to a plumbing fitting for plumbing systems, and more particularly relates to a fitting device which can be effectively employed in new and/or old construction which has advantages over heretofore known types of plumbing fittings. For example, typical fittings are illustrated in the U.S. Pat. Nos. 622,326, 846,600, 911,748, 924,839, 991,142, 1,362,718, 1,152,973, 2,866,981, and 3,850,459.

The present invention relates generally to plumbing systems, and in particular reference to the installation and/or repair of water-closet "bends" which make the connection with and carry the soil from the closet to the soil-pipe stack, and is so constructed that it provides for the discharge of waste from the bathtub, lavatory, sink, or other fixtures into the soil-pipe stack. More specifically, the invention relates to an improved plumbing fitting device which is constructed in a manner so it provides for carrying the waste from lavatories, bathtubs, sinks, and the like into the soil-type stack and which can be readily adapted to various conditions and which may be used in a variety of positions.

In typical applications, the fitting device of the invention may be advantageously used to repair an existing closet "bend", particularly on a second floor of an existing dwelling where one wants to repipe the second floor. In such case, there will be a substantial labor and material savings where you can merely cut-off the existing waste piping and replace such piping through the lead "bend" resulting in a substantial monetary savings. This comes about by reason of the fact that you do not have to tear-out the downstairs walls or ceiling to repipe the upstairs.

In the invention, the transverse hub section includes an upper 1½ inch port and a lower 2 inch port with the upper port being disposed above the longitudinal center line of the fitting device. By this arrangement, the piping for a lavatory and tub may be taken out of the top of the fitting, whereas, the lower port may act as a waste for a shower. Accordingly, the upper port may act as a vent which may be useful in an apartment house with the plumbing fixtures on the other floors coming down the same stack. Therefore, by this arrangement there is provided a wide flexability in the use of the fitting device in residential, industrial and commercial applications.

In the invention, a further advantage is to minimize the tendency to "plug-up". For example, many plumbing codes object to horizontal piping of reduced diameter (i.e. 1½ in.-2 in.) coming into a closet (bend) for the reason that there is not sufficient "sweep" area to avoid clogging or plugging. In the present invention, this problem is overcome by the reason of the fact that the interior area provides a "sweep" in both directions so that the "sweep" is not only in the direction of flow, but also in a direction opposite to the flow through the fitting device. Accordingly, in the invention the transverse hub section opens into the maximum transverse diameter of the fitting which slopes, in part, in a direction against the flow. In essence, therefore, the transverse section opens onto a maximum drainage area within the fitting which provides an optimum "spillway" to reduce any tendancy to clog or plug the fitting and hence, the plumbing system.

In a further aspect of the invention, the fitting is so constructed and arranged such that the fitting can be cut to provide a straight pipe section with pipe branches thereon. For example, in a rural type installation, you may have a hub coming out of the ground, such that you can cut the lead "bend" off to a point where it is straight and then cement the other end so that you can branch-off and then plumb the lavatory too, for example. In another words, in this case, the lavatory, (toilet) rests directly on top of the straight piece of the pipe fitting. This will be more apparent as the following description proceeds in connection with the accompanying drawings thereof.

In another aspect of the invention, it will be recognized that the fitting device of the present invention in addition to being used as a straight piece of pipe with branches, can be used in at least four (4) different positions. Accordingly, the fitting device can be used not only as a repair to an existing closet "bend", but can be used in respect to new installations in for example, a main vent on a high-rise building or the like. Moreover, many various applications of the fitting are contemplated for plumbing installations in the present invention.

In an additional aspect of the invention, the transverse multiple port arrangement overcomes the problems when obstacles are in the way and/or when the installation has an elevation or pitch problem. For example, it is general practice to arrange the toilet bowl near the vertical wall which covers the stack, to economize in space, as bathrooms are ordinarily relatively small. The coupling which is provided on the vertical stack is horizontal and at right angles to the coupling and when the toilet bowl is on center with respect to the stack, the bottom of the toilet bowl may be connected with the coupling of the stack by a unitary pipe having a straight horizontal portion. Heretofore, the coupling element has often been made in several separate connected tubular sections, including elbows or the like. Due to the short space (i.e. 12 inches) such prior couplings, as a double-Y or the like, are not only difficult to make and expensive, but requires additional space such as from 14 to 17 inches from the wall, for example.

Accordingly, in the present invention, it will be seen that there is provided a simple, yet rugged fitting device which is of a unitary, one-piece construction which saves a great deal of time and expense to the installer and hence, saving of expense to the owner of the property. The fitting device can be readily used for repair and/or new construction and enables the user to dispence with the necessity of using two or more connected fittings. Further objects and advantages of the invention will become apparent as the following description proceeds taken in conjunction with the accompanying drawings.

SUMMARY OF THE INVENTION

The present invention relates to a new and improved construction for a fitting device for plumbing applications made in the form of unitary, one-piece construction from a plastic material. The fitting comprises, a hollow, cylindrical by having an inlet end and an outlet end with the inlet end adapted to be removeably connected to a water closet and with the outlet end adapted to be connected to a vertical stack, for example. The body member includes a transversely extending hub section which comprises two pair of oppositely disposed ports arranged in superposed relationship in respect to one another. The ports are of a circular configuration defined by a pair of oppositely disposed upper ports of reduced diameter and another pair of oppositely disposed lower ports of enlarged diameter with the longitudinal axis of the ports being disposed at right angles to the longitudinal axis of the fitting. The superposed upper and lower ports together define a generally figure-eight construction with the longitudinal axis of the upper and lower ports being disposed in the same general plane with one another. The interior of the ports communicate with the interior of the fitting so as to define and enlarged area interiorly of the cylindrical member so as to provide fluid flow in opposite directions thereby to reduce clogging or plugging of the fitting during the normal use thereof. The ports are adapted for ready connection with the upper port being adapted for connection as a toilet vent or lavatory waste, and the lower port adapted for connection to the shower or lavatory waste. Preferably, in the invention the upper ports are disposed above the longitudinal center line of the fitting with the lower ports being disposed below such center line such that the upper ports can be used as a vent to prevent siphoning of the system. That is, the upper ports are located above the plane of flow through the fitting so that such flow will not exert a siphoning action on the pipes connected with any branch outlets connected to any fixtures in the plumbing system. Also, in the invention, the body member may include an integral bend portion for connection to a closet or the like as known in the art. Further, the invention contemplates that the body member is constructed and arranged so that it can be cut-off to predetermined lengths so as to be used as a straight pipe fitting for use in a rural type installation or the like. This greatly adds to the versitility of the fitting which can be utilized in at least four (4) different positions.

DESCRIPTION OF THE PREFERRED EMBODIMENTS

Figure 10:
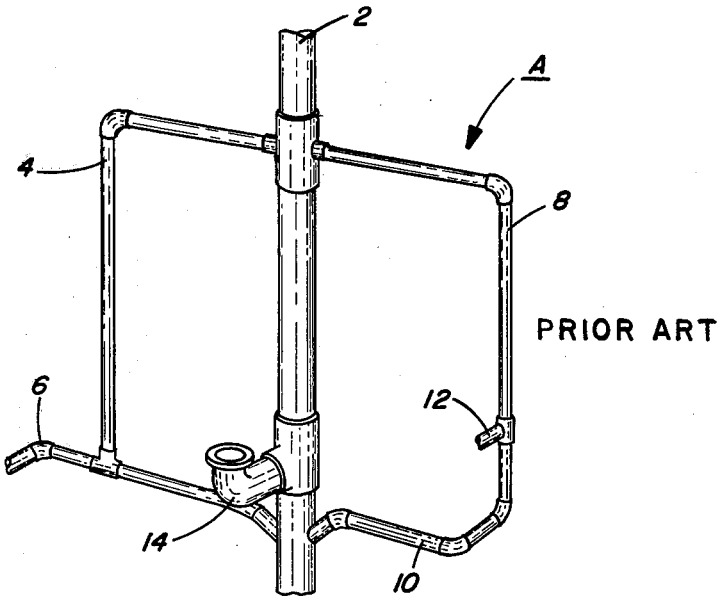
FIG. 10 is a fragmentary, generally perspective diagromatic illustration of a typical plumbing installation known in the art.
Figure 11:
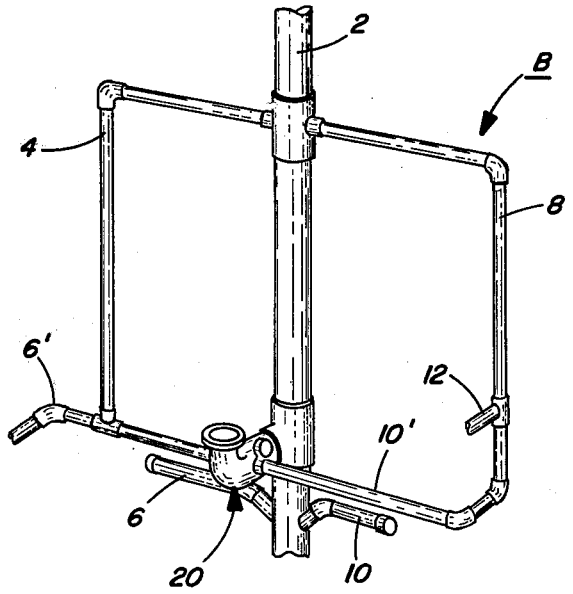
FIG. 11 is a fragmentary, generally perspective view of a typical plumbing installation utilizing the fitting device of the present invention.

Referring again to the drawings and in particular to FIGS. 10 and 11 thereof, there is illustrated a conventional plumbing installation illustrated diagromatically at A and an installation made in accordance with the present invention illustrated at B. As shown, the conventional installation A includes a vertical soilstack 2 with ½ inch laterals including a waste 4, 6 to a bathtub and 8, 10 for a vent or lavatory waste. The lateral 8 may also include another lateral 12 as a waste from a sink. As seen, the system includes a conventional bend 14 connected at one end to the stack 2 and at the other end to a toilet, as known in the art. This illustration, for example, illustrates a typical second floor plumbing installation in a residence sought to be repaired. Now in accordance with the present invention, the fitting device of the present invention, designated generally at 20, has been installed by merely replacing the conventional bend 14 and then by simply capping the pipes 6 and 10 going to the lavatory and bath-tub. This can be accomplished by what they call "No-Hub" fittings which is a rubber clamping type cap, for example. Accordingly, one then simply installs new pipes 6' and 10' into the fitting device 20 which overcomes any need to tear out the downstairs walls or ceilings to re-pipe the upstairs, if desired.

In the drawings, FIGS. 1 through 4 illustrate generally the fitting device 20 of the invention. In the form shown, the device 20 includes a generally L-shaped hollow, cylindrical, body member 22 which has an upper straight portion 24 and a lower straight portion 26 connected together by a 90° bend portion, as at 28. In the invention, the fitting is preferably made from a high strength plastic material such as ABC or PBC plastic or the like. The upper straight portion 22 may be connected to the toilet via a standard type closet flange, illustrated in a dotted line in FIG. 1, as at 30. The opposite inlet end 32 may be connected to the vertical soilstack in a manner, as known in the art. Typically, the fitting has an outside diameter of 4⅝ inches. The upper straight section 22 joins the lower section with a relatively short radius R so as to provide a compact lengthwise dimension for the fitting.

Figure 7:
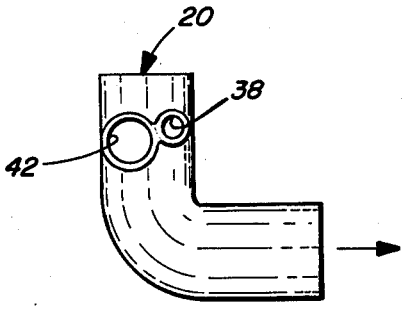

Now in accordance with the invention, the lower straight or horizontal portion 26 includes a transversely extending integral, hub section, designated generally at 34, disposed at right angles to the longitudinal axis of the fitting. As shown, the hub section includes an upper pair of oppositely disposed and axially aligned passages 36 (FIG. 4) which communicate with a pair of ports 38 which communicate with the exterior of the fitting. Preferably, the upper ports 38 have a diameter of 1½ inches. Below the passages 36 are provided another pair of oppositely disposed, axially aligned passages 40 which communicate with lower ports 42 which have a diameter of 2 inches. The passages 36 and ports 38 are disposed in vertical alignment with the passages 40 and ports 42 and are separated by web portions 44 so as to define a generally figure eight construction on either side of the fitting. As will be seen, the passages 36 and 40 communicate with the interior of the straight portion 26 so that there is in effect, provided an enlarged "sweep" area to accommodate flow in opposite directions so as to reduce clogging and/or plugging of the fitting. Importantly, the upper passages 36 and hence, the upper ports 38 are disposed above the longitudinal axis of the straight portion 26 of the fitting so that substantially all of the flow through the fitting is disposd below the ports 38. In FIG. 7, the ports 38 are shown off-set axially from the ports 42. Hence, the ports 38 can be off-set at any angle so long as they are disposed about the ports 42. By this arrangement, the ports given an effective venting action when it is desired to use the ports as a vent rather than as a waste outlet, for example. Moreover, the lower ports may be readily connected as a shower or lavatory waste, whereas, the upper ports may be connected for use as a toilet vent or a lavatory waste.

Figure 5:
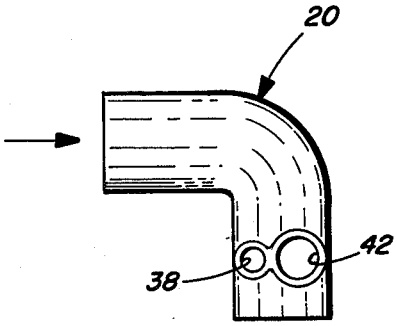
FIGS. 5, 6 and 7 are diagromatic representations showing three different positions for use of the fitting device of the invention.
Figure 6:
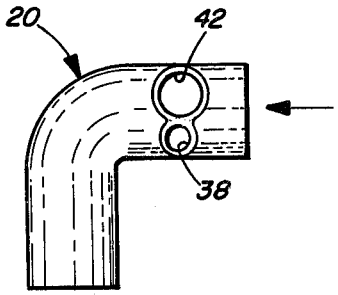

By referring to FIGS. 5, 6 and 7, it will be seen that the fitting device of the invention can be utilized in various positions. For example, in FIG. 6, the upper ports 42 may in certain cases be used as a branch line or as a main vent. In FIGS. 5 and 7, the ports may be used effectively as branch lines for the system.

Figure 1:
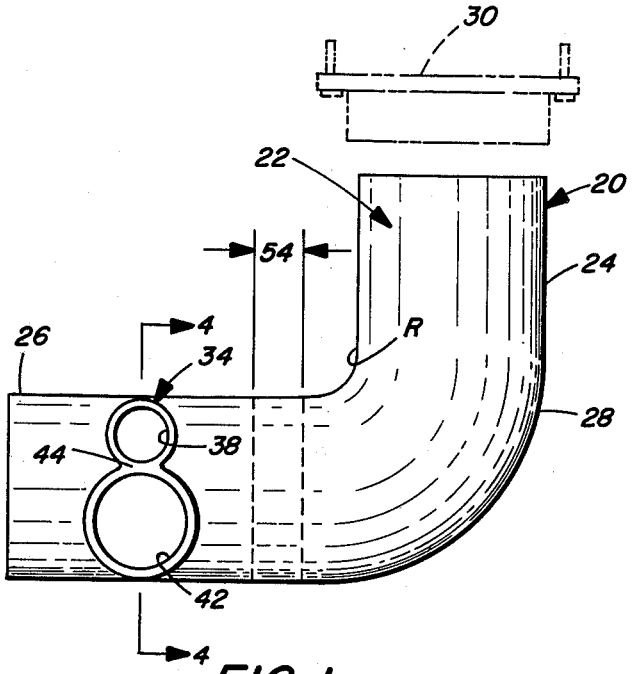
FIG. 1 is a side elevation view of the fitting device made in accordance with the invention.
Figure 2:
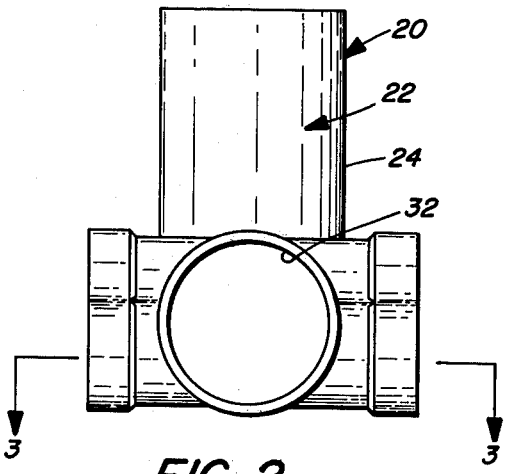
FIG. 2 is a front elevation view looking generally from the left-hand side of FIG. 1.
Figure 3:
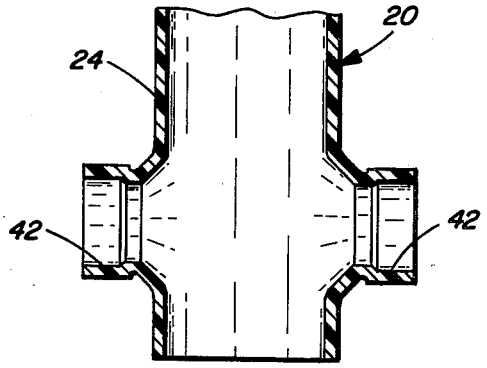
FIG. 3 is a fragmentary horizontal section view taken along the line 3—3 of FIG. 2.
Figure 4:
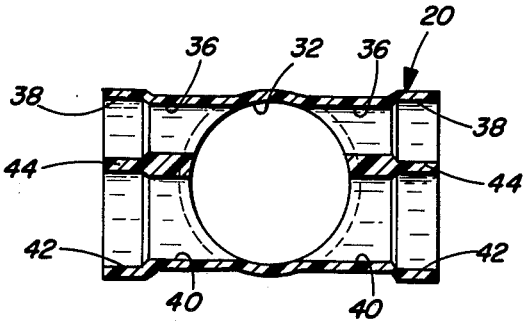
FIG. 4 is a vertical section view taken along the line 4—4 of FIG. 1.
Figure 8:
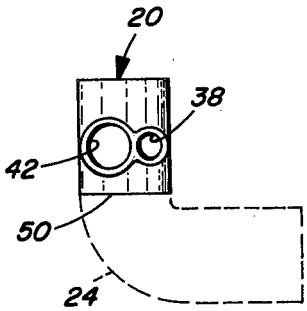
FIG. 8 is a diagromatic illustration illustrating how the bend or elbow can be cut-off to provide a straight pipe fitting device.
Figure 9:
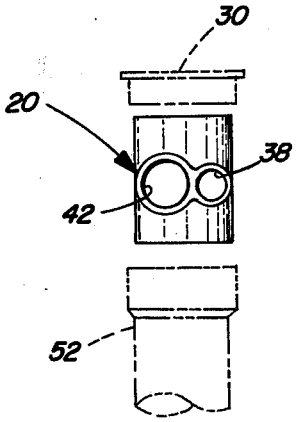
FIG. 9 is a diagromatic representation illustrating the use of the straight-pipe fitting device of FIG. 8.

FIGS. 8 and 9, there is illustrated another modification of the invention where the upper portion 24 may be cut-off along the line 50 to provide a straight pipe section for use as illustrated in FIG. 9. Here, for example, you might have a rural type installation where you merely have a hub, as at 52, coming out of the ground so that you can install the straight portion of the fitting for plumbing the lavatory room, for example. In FIG. 1, the horizontal portion 26 may have an axial section of 2 to 3 inches, as at 54, to provide sufficient material so that the fitting can be cut to the desired length for this application. In this case, the toilet would sit directly on the straight pipe section via the closet flange 30, as aforesaid. Accordingly, it will be seen that the fitting, therefore, adds great versatility, such that the fitting can be used in at least four different positions when of the L-shaped configuration in addition to being utilized as a straight section.

What is claimed is:

1. A plumbing fitting device for use in carrying waste materials from lavatories, bath tubs, sinks or the like comprising a one-piece body member made from a polymeric material having an inlet end and an outlet end with the inlet end adapted to be removably connected to a water closet or the like and with the outlet end adapted to be connected to a vent stack or the like, said body member being of a generally L-shaped configuration having an upright straight portion and a horizontally extending portion connected integrally together by a bend portion, said body member including a transversely extending hub section made integral in said horizontal section and having a transverse cross-section so as to be disposed within the peripheral confines of said horizontal section, said hub section including two pair of oppositely disposed ports, said ports being disposed entirely within the transverse dimensions of said hub section, said hub section being circular in transverse section and including transversely extending web portions that define passageways that terminate outwardly of said hub section in said ports, each of said oppositely disposed pairs of ports including an enlarged diamater lower port and a reduced diameter upper port, said upper and lower ports together defining a generally figure-eight configuration inside elevation, said upper ports being disposed above the longitudinal center line of the horizontal portion of said fitting with said lower ports being disposed below said center line such that said upper ports can be adapted as a vent to prevent siphoning of the system.

2. A fitting device in accordance with claim 1, wherein said hub section includes an upper pair of oppositely disposed and axially extending passages which communicate with said upper ports, and another pair of oppositely disposed, axially lined passages which communicate with said lower ports, said passages communicating with the interior of said horizontal portion so as to provide an enlarged "sweep" area to accomodate fluid flow in opposite directions thereby to reduce clogging and/or plugging of the fitting.

3. A fitting device in accordance with claim 1, wherein said horizontal portion can be cut-off immediately adjacent the bend area for use as a straight pipe section.

4. A fitting device in accordance with claim 1, wherein, said ports being disposed in vertical alignment with one another.

* * * * *